United States Patent [19]

Hammond et al.

[11] Patent Number: 4,830,205

[45] Date of Patent: May 16, 1989

[54] BABY FEEDING PACKS

[75] Inventors: John M. Hammond, Oxon; Leonard W. Reed, Middlesex, both of United Kingdom

[73] Assignee: MB Group, plc, Reading, England

[21] Appl. No.: 145,999

[22] Filed: Jan. 20, 1988

[30] Foreign Application Priority Data

Jan. 21, 1987 [GB] United Kingdom ..... 8701233

[51] Int. Cl.[4] ..... A61J 9/00; A61J 11/00; B65D 85/72

[52] U.S. Cl. ..... 215/11.3; 215/11.1; 222/94; 222/107; 222/490; 222/541; 426/115; 426/117

[58] Field of Search ..... 215/11.1, 11.3, 11.6; 383/38, 36; 426/117, 115; 222/94, 107, 490, 541

[56] References Cited

U.S. PATENT DOCUMENTS

| | | | |
|---|---|---|---|
| 2,697,531 | 12/1954 | Hood | 215/11.3 |
| 3,117,874 | 1/1964 | Horan | 215/11.1 X |
| 3,255,923 | 6/1966 | Soto | 215/11.3 X |
| 3,386,604 | 6/1968 | Fields | 215/11.3 |
| 3,746,215 | 7/1973 | Ausnit et al. | 383/36 X |
| 3,871,542 | 3/1975 | Hammer | 215/11.3 |
| 3,991,912 | 11/1976 | Soto | 215/11.3 X |
| 4,198,030 | 4/1980 | Jackson et al. | 251/61.5 |
| 4,411,358 | 10/1983 | Bennwik et al. | 383/38 X |
| 4,553,971 | 11/1985 | Ashley et al. | 383/38 X |
| 4,640,425 | 2/1987 | Cabernoch | 215/11.6 |

FOREIGN PATENT DOCUMENTS

| | | | |
|---|---|---|---|
| WO85/04549 | 10/1985 | PCT Int'l Appl. | 215/11.1 |

*Primary Examiner*—Sue A. Weaver
*Attorney, Agent, or Firm*—Diller, Ramik & Wight

[57] ABSTRACT

A baby feeding pack comprises a pouch-like bag for containing a liquid infant food or drink having walls of flexible sheet plastics material and a gusset, also of a flexible plastics sheet material, sealed to the walls and carrying a teat with a removable closure. The gusset defines part of a sealed auxiliary compartment in which the teat is disposed and protected from contamination and which is closed by a top seal between the walls or between the upper margins of a sheet which also forms the gusset. On opening the auxiliary compartment along a severance line, the gusset can be inverted to form a frustoconical projection by which the teat is presented for access for feeding.

5 Claims, 1 Drawing Sheet

BABY FEEDING PACKS

BACKGROUND OF THE INVENTION

1. Field of the Invention

This invention relates to baby feeding packs for containing liquid foods or drinks, such as fruit juices or milk-based liquid foods. The packs are principally intended for feeding human babies but may also be used for feeding baby animals. 2. Description of the Related Art Known baby feeding packs generally employ bottles of breakable glass or of rigid plastics, with teats which are not enclosed in a sterile environment they are therefore bulky and generally inconvenient to transport, and may be subject to breakage or cracking; moreover, because of their rigidity they do not allow the rate of feeding to be controlled by the user, that is to say, the person feeding the baby.

European Patent Application No. 0038312 describes a package suitable for storage of preparations for parenteral administration, e.g. intravenous infusion solutions, which is designed to protect the contents from the influence of light, microbial contamination and gas transport in either direction but which makes possible a visual control of the contents before the package is used. For these purposes, the package is made of a light-proof outer bag and a light permeable inner bag arranged inside the outer bag. The outer bag and the inner bag are each sealed at one of their ends and are bonded around their periphery close to their other end, and the two bags extend over this bond and are then commonly joined and sealed. Opening one of the end seals in the outer bag permits the inner bag to open out under the weight of the liquid contents to form a bottom portion of the bag, and the contents of the package can then be observed visually through the wall of the inner bag. A tapping device of conventional design may be arranged in the wall of the inner bag so as to be accessible when the inner bag has been turned out of the outer bag.

In our British Patent Specification No. 2117349 and the corresponding European Patent Specification No. 0103607, we have described a pouch-like bag for containing liquids for medical or surgical use having two walls formed by respective portions of a flexible plastics sheet material sealed together around at least their top and side edges, and at least one folded portion of a flexible plastics sheet material which is disposed between the walls of the bag and arranged to form a gusset by which the bag is subdivided internally into a primary compartment for the liquid product, and a sealed auxiliary compartment. An element or elements for receiving a needle for connection with the bag contents is or are mounted on the gusset. The gusset is small in relation to the walls of the bag, and arranged so that access to the element or elements for dispensing product may be achieved by opening the auxiliary compartment to allow the weight of the liquid product to open the gusset which accordingly forms a substantially flat bottom portion of the bag. This bottom portion extends substantially perpendicular to the walls of the bag and presents the element or elements for insertion of a needle or needles in a direction substantially parallel to the walls of the bag so as to avoid risk of accidental penetration of the walls. In the bag described in the above-mentioned British Patent Specification No. 2117349, the gusset is attached to the walls of the bag along the peripheral margins remote from its fold. In addition, it has its ends incorporated into the side seals of the bag and so it is restrained against any substantial outward bulging such as would incur the risk of accidental needle penetration of the bag walls.

U.S. Pat. No. 4,196,030 describes a method of making an extruded construction for plastic bags with gusset bottoms which may be of triangular shape and invertible to produce a funnel spout.

SUMMARY

An object of the present invention is to provide a baby feeding pack which is readily transportable without risk of breakage and or cracking, be kept sterile up to the moment when it is required for use, and enables the rate of feeding to be controlled by the user.

According to the present invention, there is provided a baby feeding pack comprising a pouch-like bag of a flexible plastics sheet material for containing a liquid food or drink, the bag comprising opposed walls sealed together, directly or indirectly, around their periphery, and a folded gusset disposed between the walls and connected thereto along its peripheral margins remote from its fold so as to subdivide the container into a primary compartment for the food or drink, and an openable sealed auxiliary compartment isolated from the contents of the primary compartment, wherein the gusset carries, within the auxiliary compartment, a teat whose interior communicates with the primary compartment and which has a removable closure preventing passage of the food or drink through the teat into the auxiliary compartment, and the gusset has closed ends which extend from the fold to its peripheral margins and which are free of the peripheral seal between the walls of the bag, so that pressure exerted on the contents of the bag via the walls following opening of the auxiliary compartment can invert the gusset so as to form a generally frustoconical projection by which the teat is presented for access for feeding.

With this arrangement, the pack is secure against breakage or leakage and the teat is kept in the sealed auxiliary compartment up to the moment of use. The bag can easily be transported and heated, if necessary, by immersion in hot water. On opening the auxiliary compartment and applying pressure to the bag, the teat is presented to the baby in a convenient manner. The flexible nature of the bag obviates any problem of reduction of pressure within the pack as feeding proceeds and enables the rate of feeding to be controlled. Preferably the teat is attached to the gusset at the fold thereof, being sealed to the gusset around a central aperture therein.

In one construction, the walls are formed by respective unitary portions of the flexible plastics sheet material sealed directly to one another all around their periphery and the gusset is formed by a futher unitary portion of flexible plastics sheet material which is bonded to the plastics material of the walls along its peripheral margins. In an alternative construction, the walls are formed of respective unitary portions of the flexible plastics sheet material sealed directly to one another around the sides and bottom of the bag and sealed indirectly to one another at the top of the bag by being sealed to a further unitary portion of flexible plastics sheet material which forms the gusset, the said further unitary portion extending above the said seals to the walls and being provided with a top seal closing the auxiliary compartment.

The auxiliary compartment may be adapted to be opened by severance of the walls of the bag or of the further unitary portion along a severance line above the gusset.

DESCRIPTION OF THE PREFERRED EMBODIMENTS

Figure 1:
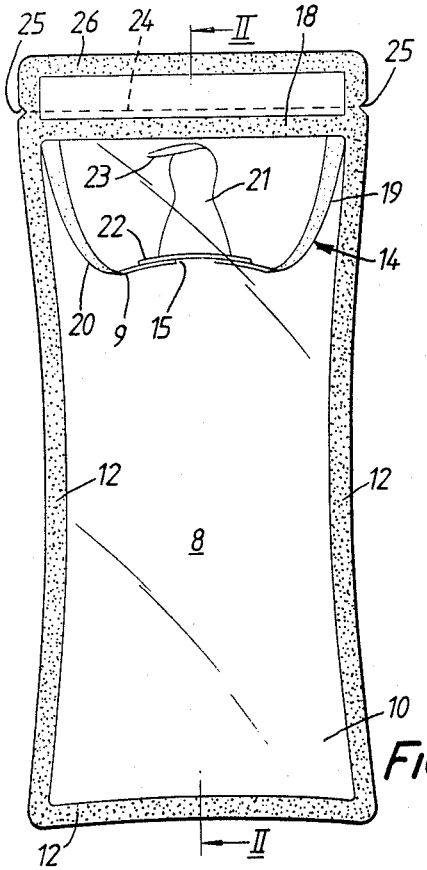
FIG. 1 is a diagrammatic elevation of a baby feeding bag in accordance with the invention.
Figure 2:
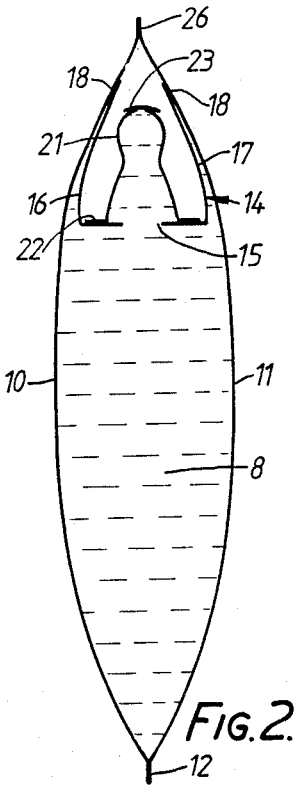
FIG. 2 is a diagrammatic cross-section on line II—II of FIG. 1.

As shown diagrammatically in FIGS. 1 and 2, a one-trip (i.e. non-refillable) baby feeding pack comprises a thermally sterilisable bag containing a liquid baby feeding product 8. The bag is substantially rectangular and elongate, and has two substantially rectangular walls 10,11 formed by respective unitary portions of a flexible plastics sheet material which are peripherally heat-sealed together at 12 and 26 around their bottom, side and top edges as shown.

In the upper end of the bag, a centrally folded unitary gusset portion 14 of a flexible plastics sheet material having an aperture 15 centred on its fold 9 is disposed between the walls 10,11, and each leaf 16,17 of the gusset portion 14 is heat-sealed at 18 along its free peripheral margin to the respectively adjacent wall 10,11, along a horizontal line parallel and adjacent to the top of the bag, so as to form a liquid-tight continuation of the side seal 12 at each end.

The walls 10,11 and the gusset portion 14 may be made of any suitable flexible plastics sheet material, which may be laminated or monolayer as desired and is preferably transparent. Advantageously, the walls and the gusset portion are each formed of an outer heat-resistant film, and a heat-sealable inner film to which the outer film is bonded; the outer film may be, for example, a nylon, polyester or polypropylene and the inner film a polyolefin or modified polyolefin.

At each end of the fold 9 the leaves 16,17 of the gusset portion 14 are cut at an angle so as to converge towards the bag interior as shown. They are heat-sealed to one another along seals 19,20 which join the intersection of the side seals 12 with the seals 18 and form an acute angle with the seals 18. The seals 19,20 form the ends of a gusset which is provided by the gusset portion 14 within the bag, and which subdivides the bag interior into a primary compartment for the liquid product, and an auxiliary compartment as is described below. The height of the gusset is between 5% and 50%, typically 15%, of the height (longitudinally) of the bag, and the gusset occupies a correspondingly small part of the bag. The angle formed between the seals 19, 20 and the adjacent side seals 12 is typically between 10° and 25°, but any angle up to about 60° is believed possible.

A sucking teat 21 of rubber or other suitable flexible material is located between the leaves 16,17 of the gusset portion and has its base 22 sealed to the gusset portion around the aperture 15. The usual dispensing hole at its top end is closed by a peelable strip 23, so that the gusset as a whole is liquid-tight.

The walls 10,11 of the bag extend above the upper edges of the two leaves 16,17 of the gusset portion 14, and there they are sealed together by heat seals 26 so as to complete the peripheral heat seal 12 and form with the gusset the sealed auxiliary compartment mentioned above, in which the teat 21 is disposed and protected from contamination and the ingress of sterilising fluid and of liquid product from the primary compartment. It will be noted in passing that the gusset portion is disposed to present its interior to the auxiliary compartment.

To open the auxiliary compartment to provide access to the teat 21, the bag is torn or cut along a severance line 24 which is defined by tear initiating formations 25 (e.g. cuts or notches) located above and adjacent to the seals 18.

Figure 3:
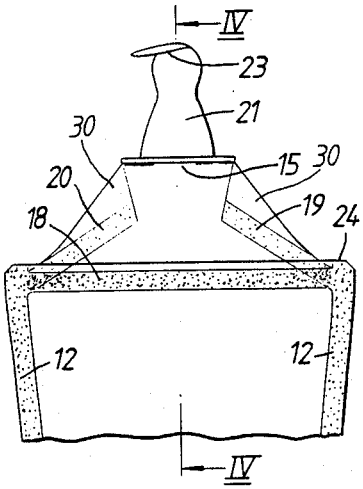
FIG. 3 diagrammatically shows the upper part of the bag of FIG. 1 with the gusset portion opened outwards to present the teat for use.
Figure 4:
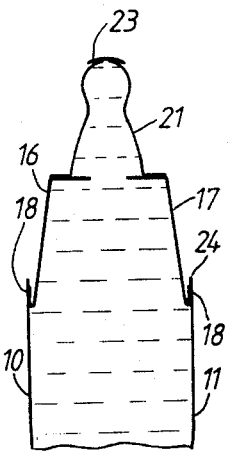
FIG. 4 is a diagrammatic sectional view on the line IV—IV of FIG. 3.

As illustrated in FIGS. 3 and 4, in use of the bag shown in FIGS. 1 and 2 the auxiliary compartment is opened by the user by severing the bag along line 24 as described. The opening of the auxiliary compartment allows the gusset portion 14 to be opened outwards so that the gusset is inverted and, by virtue of the inclination of the gusset end seals 19,20 and their freedom of mobility in relation to the peripheral seal 12, thereafter forms a generally frustoconical projection presenting the teat 21 for access by an infant. It is to be noted that the gusset portion has a sufficient inherent rigidity that it is incapable of being inverted by the weight of the liquid product 8 alone, even when the bag is violently shaken. To invert the gusset the user needs to apply a substantial pressure to the product through the walls 10,11 of the bag by squeezing. Premature inversion of the gusset after the bag has been severed along line 24 is thereby prevented.

FIGS. 3 and 4 show the bag as it appears at this stage. From FIG. 3 it will be seen that the end seals 19,20 are located naturally within reentrant folds or edge gussets 30. These tend to open and diminish in size in response to pressure applied to the bag by the user, but at all times the cut edges of the gusset portion 14 along the seals 19,20 will face the interior of the bag and therefore cannot represent a danger to the feeding infant; in addition, the projection formed by the gusset holds the teat well clear of the possibly sharp edges which are formed along the severance line 24 when the bag is opened. It will be noted that by virtue of the edge gussets 30 the shoulders of the frustoconical projection have a greater inclination to the longitudinal ends of the bag than that of the seals 19,20 before the auxiliary compartment is opened.

Before feeding can commence the peelable strip 23 must be torn away by the user to open the dispensing hole (not shown) in the teat 21. During feeding, the rate at which the liquid product is imbibed by the baby may be controlled by the user as desired, by variation of pressure applied to the bag.

Figure 5:
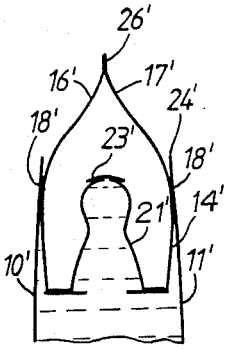
FIG. 5 is a view corresponding to the upper part of FIG. 2 of a modified bag.

FIG. 5 illustrates a second embodiment, which is a modification of the bag of FIGS. 1 through 4 and similar components thereof are identified by like though primed reference numerals. The portions of sheet material forming the walls 10',11' of the embodiment of FIG. 5 are now terminated at 24' immediately above the seals 18', and the opposed leaves 16',17' of the gusset portion 14' are extended to the top edge of the bag so as to form the upper parts of the walls. At the top edge of the bag the leaves 16',17' are sealed to one another at 26' above the seals 18' to complete the peripheral heat seal (not shown) corresponding to the peripheral heat seal 12 of the bag of FIGS. 1 through 4 and to close the auxiliary compartment for the teat 21' which has a hole closed by a peelable strip 23'. Tear initiating formations corresponding to the tear initiating formations 25 of FIGS. 1 through 4 are formed in the leaves 16',17' above the seals 18' to assist the opening of the auxiliary compartment along a line corresponding to the line 24 of the bag of FIGS. 1 through 4, as previously described.

Whilst in the embodiments shown in the drawings the gusset end seals 19,20 are substantially straight and inclined in relation to the side edges of the bag so as to be mutually convergent towards the bag interior, within the scope of the invention are arrangements wherein the ends of the gusset are non-linear and/or they are at least partly parallel to the side edges of the bag. Providing that the peripheral margins are sealed together so as to prevent escape of the liquid product from the primary compartment into the auxiliary compartment, the gusset ends may if desired terminate immediately adjacent to, or at a small spacing from, the intersection of seals 18 and 12.

The bags shown in the drawings and described above may be manufactured by a form-fill seal operation or they may be supplied as preformed bags to the baby food manufacturer. Although not essential, preformed bags will usually be filled with product through the open bottom end as shown in the drawings, after which the bottom end is sealed closed to complete the bag for sale. In the latter case filling will occur with the "bottom" end upwards, and it is to be understood that the use of the words "bottom" and "top" to describe the ends of the bag is only for convenience and in no way is to be considered as limiting.

As with the described embodiment, a bag in accordance with the invention may have its walls and/or its gusset made of a monolayer flexible plastics sheet material, or they may be of laminated construction. In one possible construction the walls and the gusset are integrally formed from a single portion of a monolayer or laminated sheet plastics material which is folded longitudinally into W formation.

We claim:

1. A baby feeding pack comprising a pouch-like bag of a flexible plastics sheet material for containing a liquid food or drink, the bag including opposed walls with means for sealing said walls around the periphery to thereby form a peripheral seal, a folded gusset disposed between the walls and connected thereto along its peripheral margins remote from its fold so as to subdivide the container into a primary compartment for the food or drink and an openable sealed auxiliary generally frustoconical compartment isolated from the contents of the primary compartment, the gusset carries within the auxiliary compartment a teat whose interior communicates with the primary compartment and which has a removable closure preventing passage of the food or drink through the teat into the auxiliary compartment, the gusset has closed ends which extend from the fold to its peripheral margins, said gusset closed ends being free of the peripheral seal between the walls of the bag whereby pressure exerted on the contents of the bag via the walls following opening of the auxiliary compartment causes inversion of the gusset and forms a generally frustoconical projection from the generally frustoconical compartment by which the teat is presented for access for feeding.

2. A baby feeding pack according to claim 1, wherein the teat is attached to the gusset at the fold thereof, being sealed to the gusset around a central aperture therein.

3. A baby feeding pack according to claim 1, wherein the walls are formed by respective first and second unitary portions of the flexible plastics sheet material, said first and second unitary portions being sealed directly to one another by said sealing means all around their periphery, and the gusset is formed by a third unitary portion of flexible plastics sheet material which is bonded to the plastics material of the walls along its peripheral margins.

4. A baby feeding pack according to claim 1, wherein the walls are formed in part by respective first and second unitary portions of the flexible plastics sheet material, said first and second unitary portions being sealed directly to one another by said sealing means around a part of the sides and the bottom of the bag, the walls being further formed in part by wall-forming parts of a third unitary portion of flexible plastics sheet material which forms the gusset, said third unitary portion being sealed to said first and second unitary portions at transverse seals and extending above said transverse seals as parts of the said walls of the bag, and the third unitary portion above said transverse seals being sealed to itself by said sealing means around the sides and top of the bag to close the auxiliary compartment.

5. A baby feeding pack according to claim 1, wherein the auxiliary compartment is adapted to be opened by severance of a portion of the auxiliary compartment along a severance line above the gusset whereby the auxiliary compartment is opened to permit access to the teat.

* * * * *